United States Patent [19]

McQuitty et al.

[11] Patent Number: 4,949,317

[45] Date of Patent: Aug. 14, 1990

[54] COMPLIANT UNDERWATER ACOUSTIC BAFFLE

[75] Inventors: Jim B. McQuitty, Adelphi; Arnat W. Martin, Spencerville; David K. Studenick, Beltsville, all of Md.

[73] Assignee: The United States of America as represented by the Secretary of the Navy, Washington, D.C.

[21] Appl. No.: 619,075

[22] Filed: Feb. 27, 1967

[51] Int. Cl.[5] ..... H04R 1/00

[52] U.S. Cl. ..... 367/176; 367/162; 367/165; 181/286

[58] Field of Search ..... 161/160, 161; 181/0.5, 181/0.5 A, 33.01, 33.10, 33.14, 286; 248/358; 340/3, 5, 5 A; 367/162, 165, 176, 152

[56] References Cited

U.S. PATENT DOCUMENTS

| | | | |
|---|---|---|---|
| 2,270,902 | 1/1942 | Rubissow | 248/358 |
| 2,722,194 | 11/1955 | Hoffman | 115/34 |
| 2,811,216 | 10/1957 | Harris | 181/33 |
| 2,977,919 | 4/1961 | Blake | 114/20 |
| 3,110,369 | 11/1963 | Ruzicka | 181/33.4 |
| 3,117,054 | 1/1964 | Antonucci | 161/160 |
| 3,130,700 | 4/1964 | Peterson | 114/20 |
| 3,160,549 | 12/1964 | Caldwell et al. | 161/161 |

FOREIGN PATENT DOCUMENTS 1182862 12/1964 Fed. Rep. of Germany ... 181/33.01

OTHER PUBLICATIONS

B. F. Goodrich Co., Products–Materials for Underwater Sound Applications; Jul., 1961; pp. 17–21.

*Primary Examiner*—Charles T. Jordan
*Assistant Examiner*—J. Woodrow Eldred
*Attorney, Agent, or Firm*—Kenneth E. Walden

[57] ABSTRACT

An improved acoustic baffle for use with underwater hydrophone or acoustic transducer equipment on submarines and the like for attenuating acoustic energy of a noise character emanating from the submarine carrying the hydrophone equipment thereby rendering the hydrophone immune to undesired ambient noise conditions, incorporates a laminated assembly of compliant or spring like elements. One embodiment is characterized by a ribbed member for effecting a spacing of a plurality of rubber tubing type sound absorbing elements. An alternative embodiment incorporates a plurality of metallic springs for controlled compliancy of the baffle. The assembled elements are attached to a steel plate and before being placed in operation, a hydrophone or acoustic transducer is mounted on the opposite side of the steel plate.

9 Claims, No Drawings

COMPLIANT UNDERWATER ACOUSTIC BAFFLE

BACKGROUND OF THE INVENTION

The invention relates to an improved acoustic baffle of controllable frequency characteristics for attentuation of acoustic energy impingent upon an underwater transducer of a sonic detecting system for minimizing the deleterious effect otherwise produced by energy emanating from the power plant of the vessel carryin the detection system. More particularly the inventive concept is directed to an improved baffle apparatus for attenuation of noise or undesired acoustic energy by utilization of a laminated construction of elements to provide predetermined attenuation characteristics while preserving the desirable features of prior art devices incorporating an externally pressurizable pneumatic rubber mat, which is attached to a steel backing plate.

The instant invention is an improvement over a pneumatic rubber mat device of an externally pressurizable character, disclosed in the co-pending application of Donald W. Kuester, Ser. No. 357,019, filed Mar. 31, 1964 for Air Compensated Underwater Sound Barrier. The acoustic performance of a baffle of the character of the aforementioned patent application has been found to be adequate over an acceptable band of frequencies. However, certain shortcomings have been experienced due to problems encountered with respect to unavailability of materials used possessing certain desired characteristics, i.e., those used proving to be mechanically unreliable under operational conditions, and further because of difficulties directed both to fabrication and quality control problems. All other known apparatus and prior art techniques directed to methods of attempting to achieve the purpose of the instant invention have been found to be acoustically inferior to the aforementioned Air Compensated Underwater Sound Barrier.

In its broadest sense, the present inventive concept is directed to the provision of improved apparatus for attenuating acoustic noise emanating from a sea going vessel, as propagated or transmitted through the surrounding water and which noise energy is of a character normally producing adverse and deleterious effects upon the performance of an acoustic transducer used in adjacency to the exterior of the ship hull. More particularly the invention relates to a acoustic baffle construction techniques and apparatus for effectively reducing sound transmission, from the hull of a ship, such for example as that produced by hull vibrations resulting from the ship's power plant and/or other propulsion noises, to an underwater sound transducer as installed on the vessel external to the hull thereof.

Vibrations of the hull arising from sources such as moving prime mover parts and both internal and external propulsion machinery of the ship is known to produce acoustic noise energy, which when transmitted through the water after transduction by the hull of the ship or by other of the aforementioned instrumentalities, increase the likelihood of detection by underwater listening Sonar equipment of an enemy, as well as affecting as by interference with the ship own Sonar equipment, the performance of transducers used for the ship's own Sonar and other types of detection equipment.

Hydrophone or underwater acoustic transducer devices used with the Sonar equipment of a ship, are limited in the effectiveness thereof in range and directionsensitivity by noises produced by the ships propulsion machinery as transmitted to the hull, where they are transduced and propagated throughout the underwater environment ambient to the ship. This acoustic noise presents a serious problem to those vessels utilizing underwater acoustic equipment. Every effort to suppress or otherwise prevent the undesired background signals as produced by the ship machinery and propulsion equipment from being transmitted or coupled to the hydrophone or transducers mounted exterior of the surface of the ship warrants investigation.

Toward this end, underwater sound baffles have been developed for shielding the underwater transducers from noise emanating from the ship. The aforementioned Kuester et al application is an example of one such expedient. Other approaches to the solution of the problems have been characterized by the use of sound-absorbent or sound reflecting material, such for example as rubber fabricated in a honey-comb fashion with air pockets therein. Frequently these pockets, or voids, are filled with shot or the like to vary the acoustic impedance characteristics thereof. It has been found that this type of construction is not entirely satisfactory under all conditions of service, however, since the air pockets tend to collapse under high hydrostatic pressures. At depths beyond approximately one-hundred feet it has been found desirable to resort to other equipment to accomplish the desired purpose. Modern submarines operate at depths far exceeding one-hundred feet; accordingly, it is apparent that other underwater sound baffle structures capable of operating at unlimited depth must be provided if optimum performance is to be derived from the ship's Sonar and other acoustic detection equipment.

It is a feature of the instant invention to provide an improved structure untilizing a unique relationship of the elements or parts thereof, for attenuation of ambient noise energy emanating from the hull of a ship or the like, for improving environmental operational conditions of underwater acoustic transducers disposed in proximity to the hull of a ship, and for enhancement of the overall acoustical performance of the transducers.

One object of the instant invention resides in the provision of improved acoustic baffle structures of a charactor adapted for utilization with underwater acoustic transducers at deep operational depths for materially reducing or the substantially complete attenuating of noise transmitted through the water, by coupling effects of the ship's hull, in transducing random noise emanating from the ships propulsion equipment.

A further object of the invention resides in the provision of an improved underwater-sound baffle apparatus having a capability for variable pneumatic pressurization for reducing the transmission of noise from the hull of a ship to an underwater sound transducer mounted exteriorly of the ship and on the baffle.

Another object is to provide an improved underwater sound baffle apparatus presenting frequency selective sound attentuation characteristics, rendering the baffle adaptable to operation at a variety of water depths for attenuation of acoustic energy radiated from a sound source emanating within the hull of a ship and transduced by the ship's hull to the water in which a hydrophone or acoustic transducer is mounted relative to the baffle.

Other objects and attendant advantages of the instant invention will become apparent from the following detailed description of the invention when considered in conjunction with the accompanying drawings wherein:

DESCRIPTION OF THE FIGURES OF THE DRAWINGS

FIG. 1 is a fragmentary elevation view in vertical section of an acoustic baffle structure of a preferred embodiment of the invention; and FIG. 2 is a fragmentary elevation view in vertical section of an alternative embodiment of the invention.

The invention constitutes a composite baffle structure, the attenuation characteristics or properties of which are adapted for adjustment prior to or during periods of operation as desired, in order to provide a controlled boundary over any desired range of operational frequencies. The baffle generally is comprised of a plurality of layers of mass elements, one or more of which are characterized as having large specific acoustical impedance, and one or more of the layers being of a different material having a small specific acoustical impedance as compared to the acoustical impedance of water. The thickness of each layer is determined from the standpoint of selection of design parameters, by the longitudinal velocity of the sound energy passing through it, the desired lowest frequency, and other operational considerations that relate performance to overall thickness and weight. Spacing of the baffle from the transducer elements of the acoustic detection array is an important parameter in that it determines for a given baffle a range of frequencies over which it provides the desired operational properties. The baffle layer nearest the array elements is the one having the large acoustical impedance. One of the other layers which preferably is bonded or otherwise fastened to the back side of the layer having the large acoustical impedance property, comprises a fabricated material displaying gas-like characteristics, or being characterized by a large modulus of compressibility, negligible hysteresis and relatively low density. The inventive concept further envisions the utilization of air compensation to balance the internal and external pressures existant when the baffle is immersed to an operational depth in a body of water and provides for satisfactory operation of the apparatus at all water depths.

Referring now to the drawings and more particularly to FIG. 1, an acoustic baffle accordance with the instant inventive concept is indicated generally at 10. The structure comprises a plurality of resilient deformable tube-like members 11 disposed between a pair of metallic plate or lamination members 12 and 13 in a sandwiched arrangement. The supporting plate or lamination member 12 is affixed to a sheet-like layer 14 of rubber or other suitable material possessing rubber-like characteristics. The sheet layer 14 is in turn bonded as by any suitable adhesive or bonding material of a character well known in the rubber-to-metal bonding art or the art to which the instant invention pertains, to a backing plate 15 of acoustically dense material, such for example, as steel, of a thickness greater than metallic plates 12 and 13 as illustrated in FIG. 1.

The outermost surface of the plate or lamination member 13 is adhesively bonded to the rubber or plastic-like layer element 16. The layer 16 extends beyond the plate member 13 to engage the enlarged peripheral portion of plate 12 and thereby affect the sealing of the interior of the assembly relative to the exterior thereof. Clamping strip member or members 17 which may be a series of strips, or a continuous annulus or rectangular member, as desired, is disposed around the outer periphery of the face of the assembly 10 and retained by screws 18 which are fixed through layer 16 into the threaded holes in plate 12 substantially as illustrated. A fluid communication port 19 indicated diagrammatically in FIG. 1 provides a facility for pressurization of the interior or sealed off portion of the assembly 10, if desired, and for the aforementioned purposes. The tube 19 is adapted for connection to the compressed air supply of the ship in a manner as disclosed in the aforementioned Kuester application. The plate element 13 is configured to provide a plurality of mutually spaced ribs or lands 21 whereby the tubular elements 11 are constrained against lateral displacement and retained within the respective channels formed by the lands or projecting rib portions 21. The tubular members 11 are preferably thick-walled natural rubber tubing. The rubber sheet 14 is bonded to the plate member 12 and in turn to the steel plate 15 as aforementioned. The channels which provide the lands 21 may be milled into the plate member 13 or rolled or extruded, or fabricated by any other desired expedient. A sheet of nylon reinforced neoprene rubber 16 is installed with its edges sealed against the plate 12 and is understood to be coextensive across the top of the plate 13 and in general form a cover for the entire structure. An underwater acoustic transducer, such as hydrophone 22, is mounted by conventional means (not shown) on the side of backing plate 15 opposite rubber sheet 14.

Referring now to FIG. 2 of the drawing, an alternative embodiment is illustrated in generally diagrammatic form with primed reference characters utilized to designate the corresponding elements of this drawing which are of the same character as those of FIG. 1. The construction of the device of FIG. 2 differs from that of FIG. 1, primarily in that steel or beryllium copper leaf springs 11' are utilized as the complaint elements. These springs are fastened at their centers between two fabricated plates 12' and 13' which are then welded together around the peripheral edges thereof. The rubber sheet 14' is bonded to the outer surface of plate 12' and in turn to the plate 13' having a thickness greater than metallic plates 12' and 13' as illustrated in FIG. 2. In like manner the additional rubber sheet 16' is bonded to the plate element 13'. An inlet tube 19' allows for air compensation in a similar manner to that of tube 19 of FIG. 1 the use of which may be obviated if desired for operation at shallow depths of submergence. An underwater acoustic transducer, such as hydrophone 22', is mounted by conventional means (not shown) on the side of backing plate 15' opposite rubber sheet 14'. If desired suitable check and/or relief valves, not shown, may be incorporated either in line 19 or the structure of backing plate 15 if desired, thereby further facilitating variable pressurization and control of the characteristics of the baffle.

Obviously many modifications and variations of the present invention are possible in the light of the above teachings. It is therefore to be understood that within the scope of the appended claims the invention may be practiced otherwise than as specifically described.

We claim:

1. An underwater acoustic baffle for mounting contiguous to an underwater acoustic transducer, comprising:

a backing plate of a first acoustical impedance having a first surface to which the transducer is contiguously mounted and a second surface opposite the transducer;

a fabricated acoustical insulation material of a second acoustical impedance substantially lower than said first acoustical impedance, said material including a first resilient sheet layer having a first surface bonded to said second surface of said backing plate and having a second surface, a first metallic plate thinner than said backing plate having a first surface bonded to said second surface of said first flat resilientt sheet layer and having a second surface, a plurality of elongate, resilient, deformable compliant means interstitially disposed in parallel to one another and adjacent said second surface of said first metallic plate, a second metallic plate thinner than said backing plate disposed parallel to said first metallic plate and having a first surface adjacent said complaint means and having a second surface, means for constraining said complaint means from lateral displacement, a second flat resilient sheet layer bonded to said second surface of said second metallic plate.

2. The baffle of claim 1 wherein said complaint means comprises a plurality of individual hollow members.

3. The baffle of claim 1 wherein said complaint means comprises a plurality of individual thick walled, natural rubber, tubular members.

4. The baffle of claim 1 wherein said complaint means comprises a plurality of individual leaf springs.

5. The baffle of claim 4 wherein said leaf springs are metallic.

6. The baffle of claim 2 wherein said backing plate, said first flat resilient sheet layer, and said first metallic plate define a fluid port extending therethrough and further comprising a conduit tube positioned adjacent said backing plate and in fluid communication with said port therein.

7. The baffle of claim 2 wherein said backing plate is steel.

8. The baffle of claim 2 wherein said first and second flat resilient sheet layers are formed of rubber.

9. An underwater acoustic baffle for mounting contiguous to an underwater acoustic transducer, comrpising:

a steel backing plate of a first acoustical impedance having a first surface to which the transducer is contiguously mounted, a second surface opposite the transducer, and a fluid port extending from an extremity of said steel backing plate through a portion thereof and terminating at said second surface thereof; and a fabricated acoustical insulation material of a second acoustical impedance substantially lower than said first acoustical impedance, said material including a first flat rubber sheet layer having an opening therein and a first and second surface, a first metallic plate thinner than said steel backing plate having an opening therein and a first and second surface, said first metallic plate bonded on said first surface thereof to said second surface of said first flat rubber sheet layer so that said opening in said first flat rubber sheet layer is aligned with said opening in said first metallic plate, a plurality of resilient, deformable, natural rubber, tubular members disposed in parallel adjacent said second surface of said first metallic plate, a second metallic plate thinner than said steel backing plate disposed parallel to said first metallic plate and having a first surface adjacent said tubular members and a second surface, a plurality of parallel elongate ribs on said first surface of said second metallic plate mutually displaced from one another and disposed between said tubular members thereby forming a plurality of parallel channels for constraining said tubular members from lateral displacement, a second flat rubber sheet layer having a first portion thereof bonded to said second surface of said second metallic plate and a second portion thereof engaging said first metallic plate and secured thereto, said first surface of said first flat rubber sheet layer being bonded to said second surface of said steel backing plate so that said opening in said first flat rubber sheet layer is aligned with said fluid port at said second surface of said steel backing plate whereby said fabricated acoustical insulation material may be secured thereto.

* * * * *